United States Patent [19]

Campbell

[11] Patent Number: 4,512,412

[45] Date of Patent: Apr. 23, 1985

[54] SWINGING FIRE APPARATUS PUMP OPERATOR PANEL

[76] Inventor: John W. Campbell, P.O. Box 431, Tonopah, Nev. 89049

[21] Appl. No.: 463,274

[22] Filed: Feb. 2, 1983

[51] Int. Cl.[3] ..... A62C 27/00

[52] U.S. Cl. ..... 169/24; 49/257

[58] Field of Search ..... 169/24, 51, 52; 180/90; 49/257, 258, 260; 312/320, 322

[56] References Cited

U.S. PATENT DOCUMENTS

| | | | |
|---|---|---|---|
| 1,704,420 | 3/1929 | Bailey | 49/257 |
| 2,154,642 | 4/1939 | Smith | 169/24 |
| 2,209,666 | 7/1940 | Sheppard | 169/24 |
| 2,936,206 | 5/1960 | Wilmer et al. | 49/257 |

*Primary Examiner*—Joseph J. Rolla
*Assistant Examiner*—Kenneth Noland
*Attorney, Agent, or Firm*—Harvey B. Jacobson

[57] ABSTRACT

A control panel for the operator's control station of a fire fighting apparatus of the type including a body defining an outwardly opening side recess is provided. The control panel supports various gauges, switches and other operating controls and has a plurality of openings formed therein through which water inlet and outlet couplings as well as valve controlling operators project. An elongated upstanding support member is disposed adjacent and extends along a generally straight side marginal portion of the recess and is mounted from the body for guided limited lateral outward and inward shifting relative to the body along a path which generally parallels the direction in which the recess opens. The control panel includes a marginal edge portion corresponding to the side marginal portion of the recess and the panel marginal edge portion is hingedly supported from the support member for angular displacement relative thereto about an axis generally paralleling the support member. The limit of outward lateral shifting of the support member from the limit of inward shifting thereof is sufficient to outwardly displace the panel and the openings formed therein outwardly of the couplings and operators to thereby allow subsequent swinging of the panel from the closed position toward the open position thereof independent of interference between the couplings and operators with the portions of the panels defining the corresponding openings.

6 Claims, 4 Drawing Figures

SWINGING FIRE APPARATUS PUMP OPERATOR PANEL

BACKGROUND OF THE INVENTION

The operator's control panel of the pumper-type fire engine supports various gauges, switches and other operating controls therefrom and also has openings formed therein outwardly through which water inlet and outlet couplings as well as valve operators project. Under most operating conditions it is not necessary to gain access to the area of the fire engine disposed immediately behind the control panel. However, occasionally it is necessary to perform maintenance or repairs in the area immediately behind the operator panel and most pumper-type fire engines do not include structure whereby ready access may be gained to the area behind such a control panel. Accordingly, a need exists for support of the control panel in a manner which enables ready access to the area of the fire fighting equipment immediately behind the control panel.

Examples of fire fighting and other equipment including control panels of the type with which the present invention is specifically concerned as well as other types of control panels including removable components are disclosed in U.S. Pat. Nos. 1,316,616, 2,154,642, 2,209,666, 3,493,053 and 3,910,371.

BRIEF DESCRIPTION OF THE INVENTION

The control panel of the instant invention is hingedly supported for angular displacement about an upstanding axis and may be horizontally swung between open and closed positions in the manner of a horizontally swingable door. However, in order to enable swinging of the panel from the closed position thereof to the open position independent of interference between marginal portions of the panel defining openings therein with water inlet and outlet couplings as well valve controlling operators which project through some of those openings, the control panel is hingedly supported from an upstanding side marginal support member which itself is supported from the fire engine body for limited horizontal lateral shifting outward relative to the body a sufficient distance for the control panel to be displaced outwardly to a position with the openings therein disposed outward of the water inlet and outlet couplings and the outer ends of the valve operators. In this manner, the control panel may subsequently be swung to the open position thereof.

The main object of this invention is to provide a fire engine control panel supported from the body of the fire engine or other fire fighting apparatus in a manner such that the control panel may first be shifted laterally outwardly of the body of the fire apparatus and thereafter horizontally swung to the open position.

Another object of this invention is to provide a fire engine control panel support structure in accordance with the preceding object and which may be readily incorporated into the manufacture of new fire engines and may also be retrofitted to existing fire engines.

A final object of this invention to be specifically enumerated herein is to provide a control panel in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
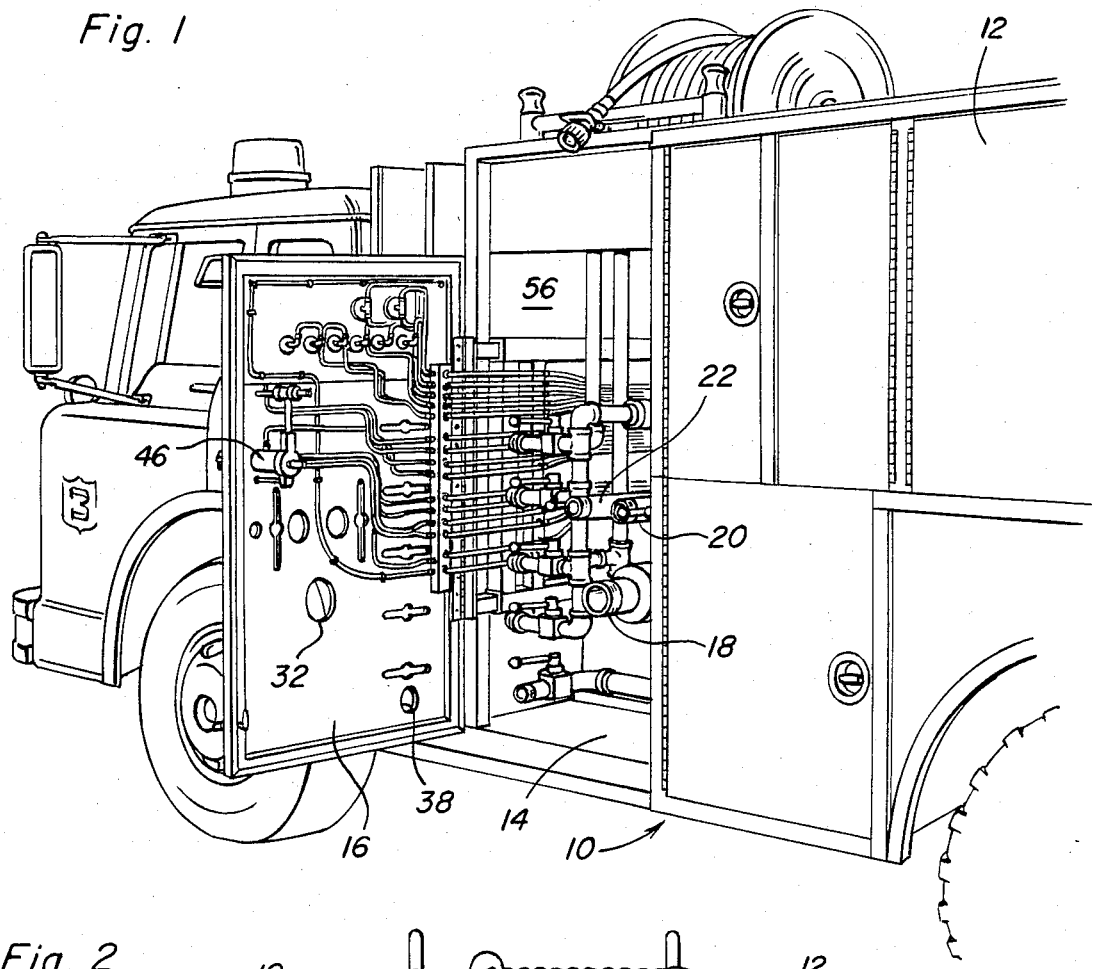
FIG. 1 is a fragmentary perspective view of a typical pumper-type fire engine incorporating the swinging operator control panel of the instant invention and with the control panel in an open position.
Figure 2:
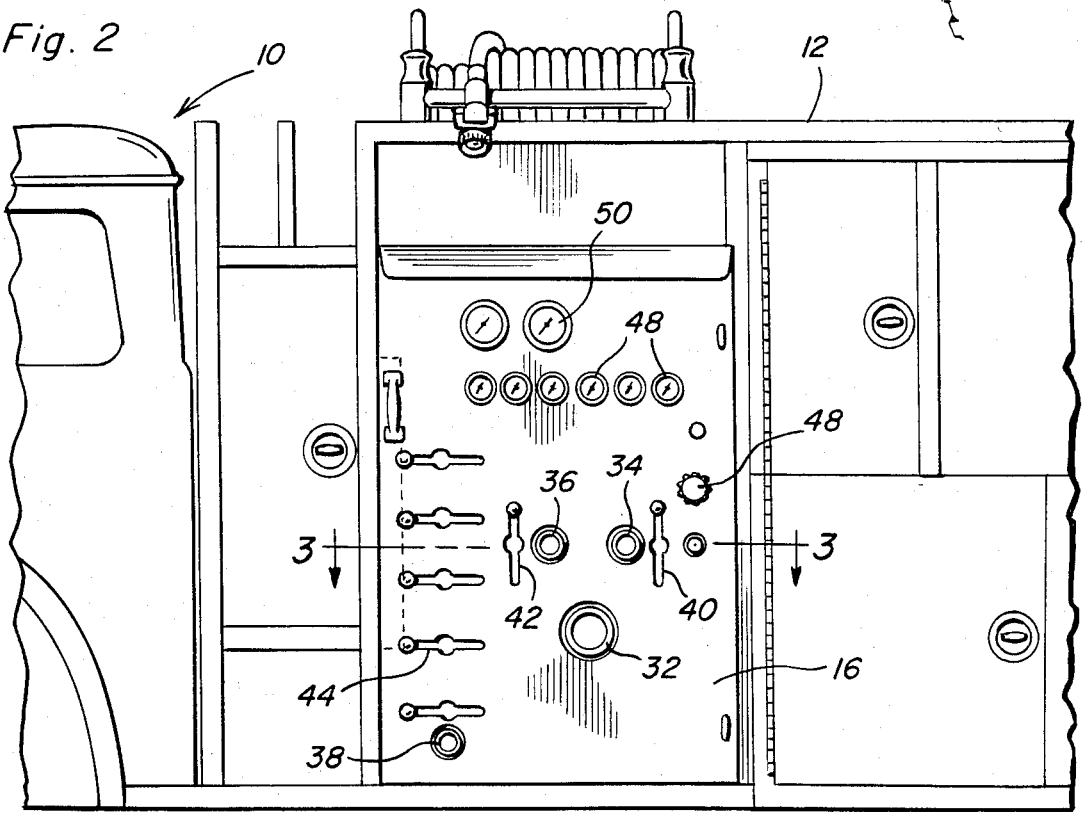
FIG. 2 is a fragmentary side elevational view of the fire engine illustrating the control panel in a closed position.

Referring now more specifically to the drawings the numeral 10 generally designates a typical fire engine of the pumper-type including a rear body portion 12 defining a laterally outwardly opening recess 14 containing various controls related to the water pumping operation of the fire engine 10. The recess 14 is removably closable by a horizontally swingable door 16 comprising a control panel.

The recess contains a water inlet or intake coupling 18, discharge couplings 20, 22 and 24 including valve operators 26, 28 and 30 and the couplings 18, 20, 22 and 24 project outwardly through openings 32, 34, 36 and 38 formed in the control panel 16. In addition, the operators 26, 28, and 30 project outwardly through openings 40, 42 and 44 formed in the control panel 16. The panel 16 additionally supports a relief valve control 46 therefrom including an operator 48 therefor which projects through a corresponding opening (not shown) also formed in the panel. Still further, the panel 16 includes openings formed therein in which various gauges 48 and 50 are mounted.

The interior of the body portion 12 includes a pair of upper and lower combined mounting and guide members 52 and 54 which are horizontally disposed and mounted upon the rear surface of a transverse vertical bulkhead portion 56 of the body portion 12. The guide members 52 and 54 are interconnected by vertical braces 56 and 58 extending and secured therebetween and are further tubular in construction with the outer ends thereof opening laterally outward of the open side of the recess 14.

A horizontal U-shaped mounting member 60 is provided and includes upper and lower legs 62 and 64 interconnected at one pair of corresponding ends by a vertical member 66 extending and secured therebetween. The legs 62 and 64 are slidably received within the guide members 52 and 54 and are slidable inward and outward of the latter.

Figure 3:
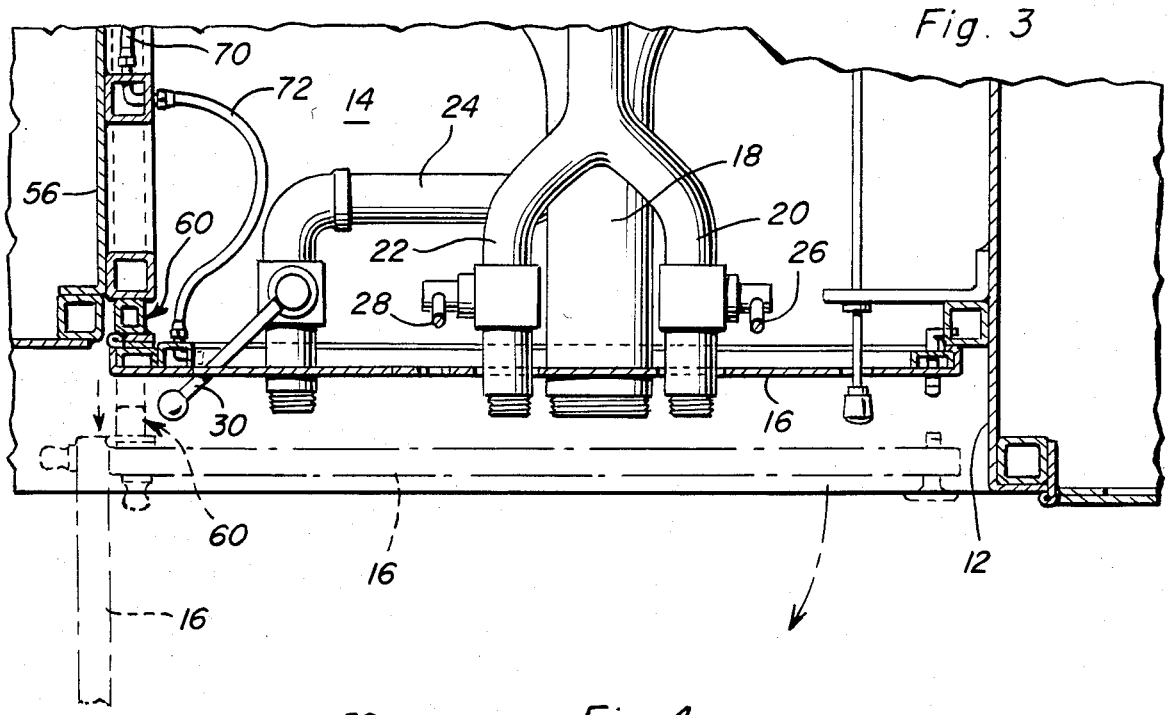
FIG. 3 is an enlarged fragmentary horizontal sectional view taken substantially upon the plane indicated by the section line 3—3 of FIG. 2.
Figure 4:
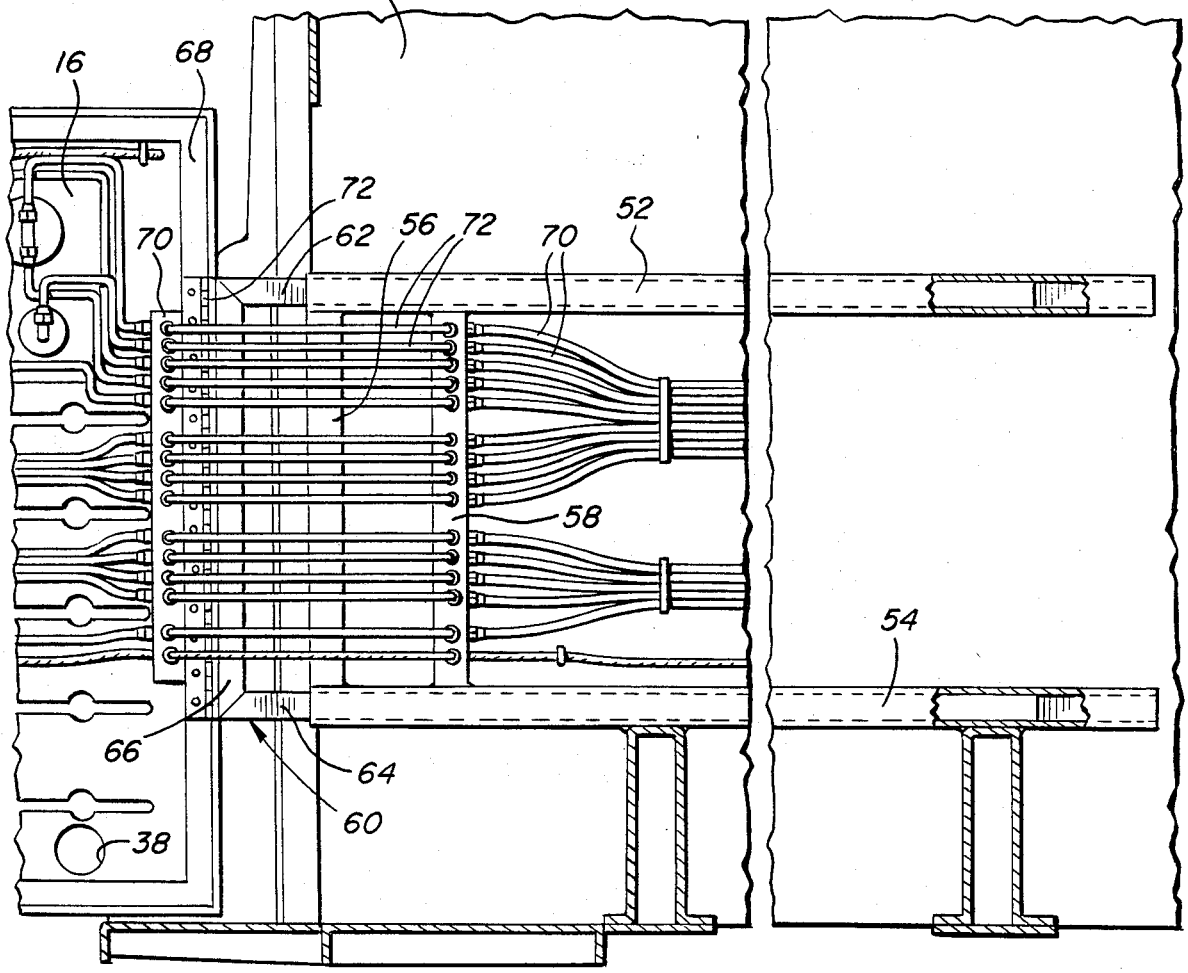
FIG. 4 is a fragmentary enlarged vertical sectional view illustrating the panel support structure and the panel in an open position.

The control panel 16 includes a vertical marginal portion 68 which is reinforced throughout its vertical midportion by a structural member extending therealong and secured thereto and a piano type hinge 72 hingedly supports the marginal portion 68 from the vertical member 66 for horizontal swinging movement of the panel 16 between a closed position such as that illustrated in solid lines in FIG. 3 of the drawings closing the outer side of the recess 14 and an open position such as that illustrated in FIG. 1 of the drawings. However, inasmuch as the couplings 18, 20, 22 and 24 and the operators 26, 28 and 30 project through corresponding openings formed in the panel 16, the latter may not be directly swung from the closed position of FIG. 3 to the open position of FIG. 1. Rather, it is first necessary for the mounting member 60 to be outwardly displaced from the inner most position thereof illustrated in solid lines in FIG. 1 of the drawings to the outwardly displaced position thereof illustrated in phantom lines in FIG. 3 of the drawings with the panel 16 disposed fully outward of the various coupling and operators above mentioned. Thereafter, the panel 16 may be swung to the open position without interference between those portions of the panel 16 defining with various openings therein interfering with the couplings and operators.

Any suitable means (not shown) may be utilized to releasably limit outward sliding movement of the mounting member 60. Further, the various pressure lines 70 extending between stationary portions of the fire engine 10 and the gauges or controls supported upon the panel 16 include flexible portions 72 thereof extending between the members 58 and 70.

Thus it may be seen that when it is desired to open the panel 16 in order to gain access to the recess 14 it is merely necessary to return the various operators projecting through the panel 16 to the neutral positions thereof, to thereafter outwardly shift the mounting member 60 from the solid line position thereof illustrated in FIG. 3 to the phantom line position of FIG. 3 and to thereafter swing the panel 16 to its full open position illustrated in FIG. 1. Of course, the panel 16 may be closed by reversing these steps.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fire fighting apparatus of the type including a body defining an outwardly opening side recess comprising an operator's control station and with said recess removably closed by a control panel supporting various gauges, switches and other operating controls and having a plurality of openings formed therethrough through which water inlet and outlet couplings as well as valve controlling operators project, support means supporting said control panel from said body for movement between a closed position closing said recess with said couplings and operators projecting outwardly through said openings and an open position providing ready access to said recess for servicing and maintenance of the various control components disposed therein, said support means including an elongated support member disposed adjacent and extending along one generally straight marginal portion of said recess, mounting means mounting said support means from said body for guided limited lateral outward and inward shifting relative to said body along a path which generally parallels the direction in which said recess opens outwardly, said control panel including a marginal edge portion corresponding to said one marginal portion of said recess and hingedly supported from said support member for angular displacement relative thereto about an axis generally paralleling said support member, said mounting means mounting said support member for lateral shifting relative to said body toward outward limit position thereof a distance sufficient to displace said panel and said openings therein fully outward of said couplings and operators to thereby allow subsequent swinging of said panel from the closed position toward the open position thereof independent of interference between said couplings and operators with the portions of said panel defining the corresponding openings.

2. The fire fighting apparatus of claim 1 wherein said generally straight marginal portion of said recess comprises a substantially vertical side marginal portion of said recess.

3. The fire fighting aparatus of claim 1 including a piano-type hinge extending along said elongated support member and hingedly supporting said panel marginal edge portion from said support member.

4. The fire fighting apparatus of claim 1 wherein said mounting means includes a pair of tubular support and guide members mounted on said body in parallel relation with one pair of ends of said guide members spaced along and opening outwardly of one marginal portion of said recess and a pair of parallel legs interconnected at one pair of corresponding ends by said elongated support member and slidingly telescopingly engaged in said tubular members with said elongated support members spaced outward of said one pair of ends of said legs.

5. The fire fighting apparatus of claim 4 including a piano-type hinge extending along said elongated support member and hingedly supporting said panel marginal edge portion from said support member.

6. The fire fighting apparatus of claim 1 wherein said mounting means includes a pair of generally parallel stationarily mounted elongated transverse guides supported within and from said body and spaced along and disposed generally normal to said one generally straight marginal portion of said recess and a pair of parallel legs interconnected at one pair of corresponding ends by said elongated support member, said legs being slidingly mounted from said elongated guides.

* * * * *